US008092236B2

(12) United States Patent
Yang et al.

(10) Patent No.: US 8,092,236 B2
(45) Date of Patent: Jan. 10, 2012

(54) BATTERY CONNECTOR

(75) Inventors: Chih-Lin Yang, Tu-Cheng (TW); Chin-Chou Wang, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 44 days.

(21) Appl. No.: 12/786,421

(22) Filed: May 24, 2010

(65) Prior Publication Data

US 2011/0287640 A1 Nov. 24, 2011

(51) Int. Cl.
*H01R 12/00* (2006.01)

(52) U.S. Cl. ..... 439/83; 439/682; 439/500; 439/571; 439/82

(58) Field of Classification Search ..... 439/500, 439/504, 83, 627, 660, 682
See application file for complete search history.

(56) References Cited

U.S. PATENT DOCUMENTS 6,551,143 B2 * 4/2003 Tanaka et al. ..... 439/83
7,387,541 B1 * 6/2008 Lai et al. ..... 439/660
7,575,469 B1 * 8/2009 Hung ..... 439/500
7,628,660 B2 * 12/2009 Ma ..... 439/862
7,722,393 B1 * 5/2010 Huang et al. ..... 439/571
7,833,069 B2 * 11/2010 Wu et al. ..... 439/500
2001/0021609 A1 * 9/2001 Chiang ..... 439/682
2003/0190848 A1 * 10/2003 Wu ..... 439/862
2008/0268712 A1 * 10/2008 Wan et al. ..... 439/627
2009/0298343 A1 * 12/2009 Wu et al. ..... 439/627

* cited by examiner

*Primary Examiner* — Briggitte R Hammond
(74) *Attorney, Agent, or Firm* — Cheng-Ju Chiang

(57) ABSTRACT

A battery connector is adapted for being assembled to a printed circuit board. The battery connector includes an insulating housing, two holding elements and a plurality of terminals. The insulating housing has two opposite side surfaces. The insulating housing defines a plurality of terminal cavities and receiving grooves. Two holding grooves are opened in two opposite ends of the insulating housing. Each side surface of the insulating housing protrudes sideward to form a locating piece. Each holding element has a base plate mounted to the holding groove and a holding piece projecting out of the holding groove to be inserted into the printed circuit board. The terminals are respectively received in the terminal cavities. Each terminal has two contacting portions having an interstice therebetween and facing towards the receiving groove, and a soldering portion projecting out of the terminal cavity to be inserted in the printed circuit board.

7 Claims, 4 Drawing Sheets

BATTERY CONNECTOR

BACKGROUND OF THE INVENTION

1. Field of the Invention

The present invention generally relates to a battery connector, and more particularly to a battery connector capable of being located on a printed circuit board firmly and accurately.

2. The Related Art

With the fast development of the information industry, portable electronic apparatuses have been widely used in our daily life, such as video cameras, personal digital assistants (PDA) and mobile phones and so on. Electrical connectors used in the portable electronic apparatuses, especially battery connectors have played an irreplaceable role on the various communication apparatuses.

In general, the battery connector includes an insulating housing and a plurality of terminals. Each of the terminals has a contacting portion and a soldering portion. The terminal is mounted in the insulating housing with the contacting portion being exposed outside to connect with one battery so as to provide power for the electronic apparatus. The soldering portion projects out of the insulating housing for being soldered to a printed circuit board.

However, in a process of mounting the battery connector to the printed circuit board, a relative movement between the battery connector and the printed circuit board may occasionally happen, so that causes the difficulty of locating the battery connector firmly and exactly. As a result, it is hard to make the soldering portion soldered to the printed circuit board successfully.

SUMMARY OF THE INVENTION

An object of the present invention is to provide a battery connector adapted for being assembled to a printed circuit board. The battery connector includes an insulating housing, two holding elements and a plurality of terminals. The insulating housing has a top surface, a front surface, a rear surface opposite to the front surface and two opposite side surfaces. The insulating housing defines a plurality of terminal cavities penetrating through the rear surface and receiving grooves passing through the top surface and the front surface. The receiving grooves are connected with the corresponding terminal cavities. Two holding grooves are opened in two opposite ends of the insulating housing. A portion of each of the side surfaces of the insulating housing protrudes outward to form a locating piece for pressing against the printed circuit board. Each of the holding elements has a base plate mounted to the holding groove and a holding piece which extends outward and then is bent downward from a middle of a bottom edge of the base plate. The holding piece projects out of the holding groove to be inserted into the printed circuit board when the locating piece presses against the printed circuit board. The terminals are respectively received in the terminal cavities. Each of the terminals has a base portion of which two opposite side edges extend upward to form a pair of propping portions. Two front edges of the two propping portions extend forward to form two elastic portions. And two contacting portions are protruded from two free ends of the elastic portions to form an interstice therebetween, and facing towards the receiving groove. A portion of a rear edge of one of the propping portions extends rearward and then is bent downward to form a soldering portion projecting out of the terminal cavity to be electrically inserted in the printed circuit board.

As described above, when the battery connector is assembled to the printed circuit board, the locating pieces of the insulating housing press against the printed circuit board to increase a supporting area of the insulating housing on the printed circuit board so as to make the battery connector located on the printed circuit board firmly, and the holding pieces of the holding elements are inserted into the printed circuit board to fasten the insulating housing on the printed circuit board accurately. So that the soldering portions of the terminals can be conveniently soldered to the printed circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
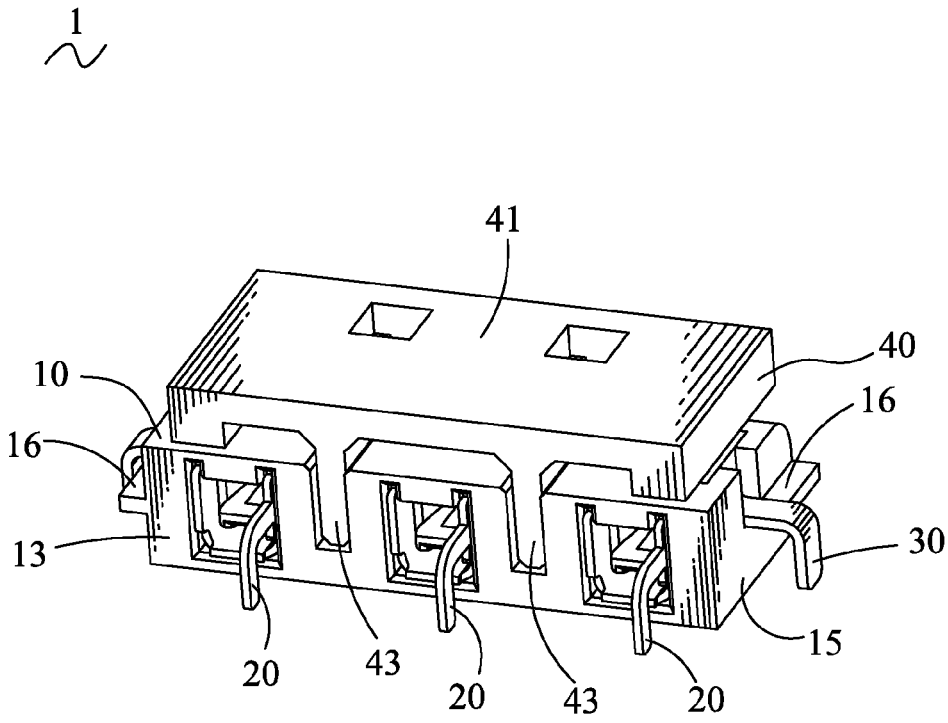
FIG. 1 is a perspective view of a battery connector according to the present invention.
Figure 2:
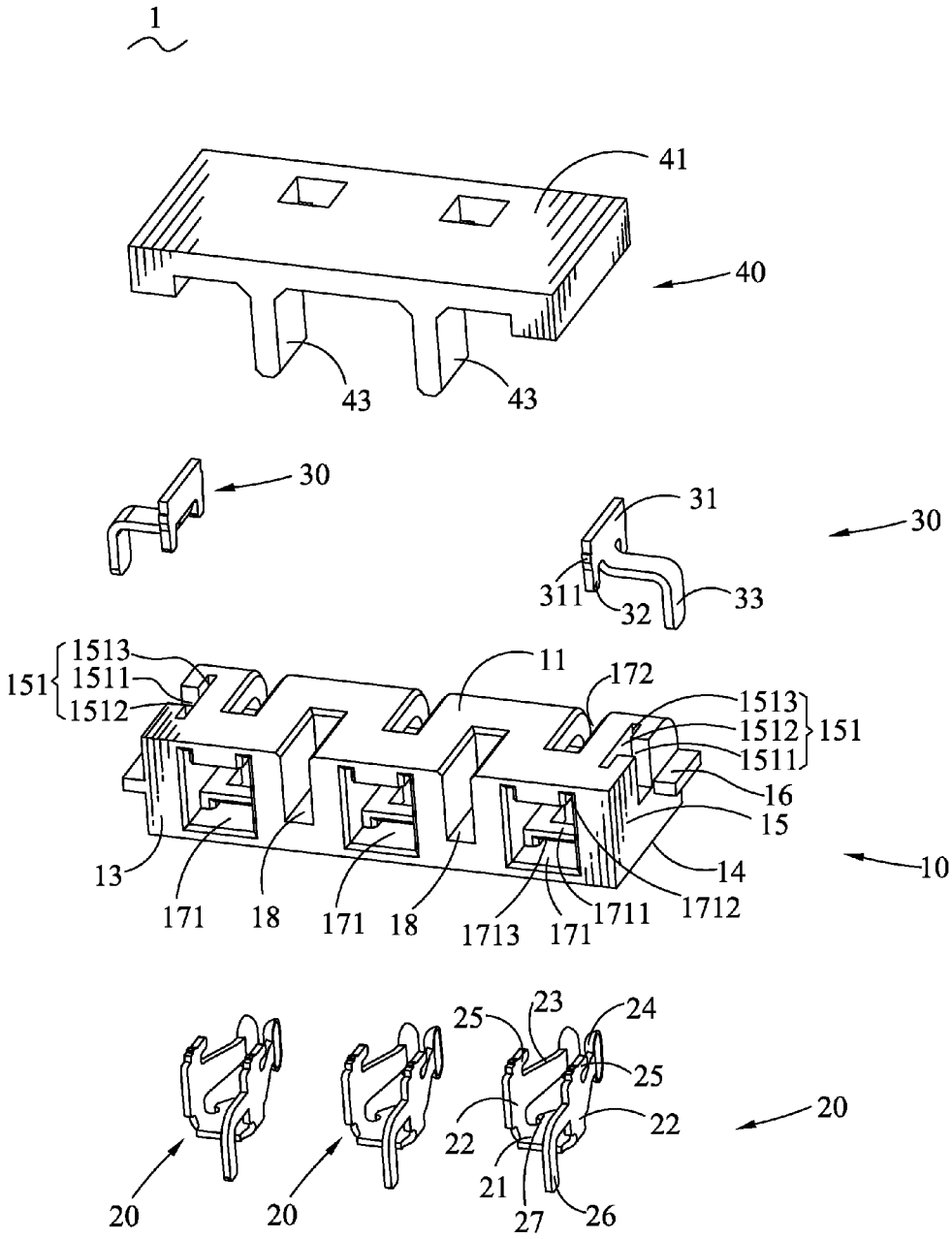
FIG. 2 is an exploded view of the battery connector of FIG. 1.

Referring to FIGS. 1-2, a battery connector 1 according to the present invention is shown. The battery connector 1 includes an insulating housing 10, a plurality of terminals 20, two holding elements 30 and a cover 40.

Figure 3:
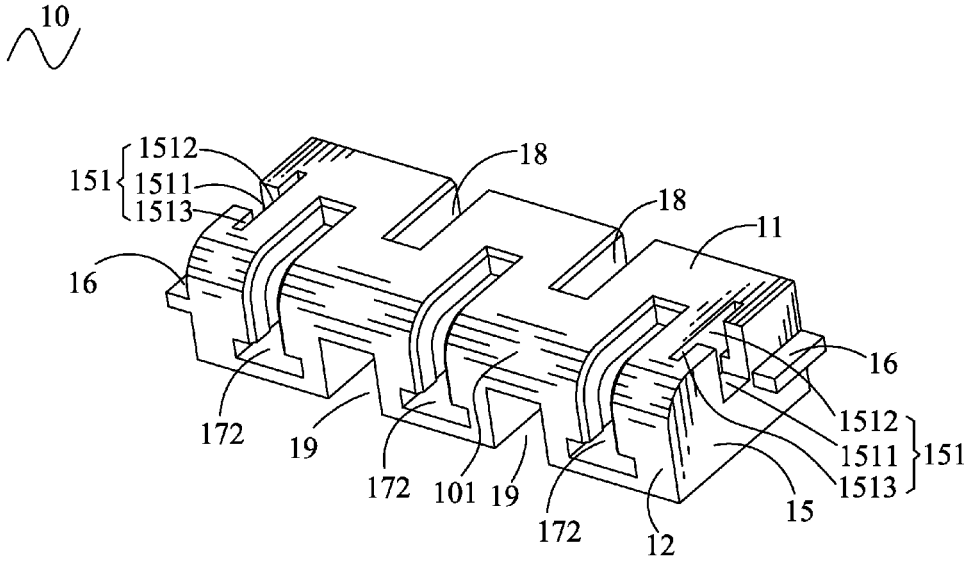
FIG. 3 is a perspective view of an insulating housing of the battery connector of FIG. 1.

Referring to FIGS. 1-3, the insulating housing 10 is of a cuboid shape and has a top surface 11, a front surface 12, a rear surface 13 opposite to the front surface 12, a bottom surface 14 opposite to the top surface 11 and two opposite side surfaces 15. The top surface 11 and the front surface 12 are connected with each other by an arc face 101. Substantial middles of the two opposite side surfaces 15 oppositely protrude to form two locating pieces 16 extending longitudinally and adjacent to the front surface 12 and the rear surface 13, respectively. Two opposite ends of the insulating housing 10 respectively define a fixing slot 1512 extending longitudinally and penetrating through the top surface 11, and a receiving channel 1511 connected with a middle of the fixing slot 1512 and passing through the corresponding side surface 15. Two outmost ends of the fixing slot 1512 vertically extend to form a pair of inserting slots 1513. The receiving channel 1511, the fixing slot 1512 and the pair of inserting slots 1513 together define a holding groove 151. The insulating housing 10 defines a plurality of terminal cavities 171 arranged at regular intervals along a transverse direction thereof. The terminal cavity 171 is opened from the rear surface 13 and extends towards the front surface 12. A receiving groove 172 extends from a middle of a front of the fastening cavity 171 to penetrate through the front surface 12 and the top surface 11. A pair of fastening fillisters 1712 are opened in a top inside of the fastening cavity 171 and spaced from each other to be adjacent to two opposite side faces of the fastening cavity 171. Each of the fastening fillisters 1712 extends longitudinally to penetrate through the rear surface 13. A protrusion 1711 protrudes upward from a front of a bottom face of the fastening cavity 171 and has a middle spaced from the bottom face of the fastening cavity 171 to define an inserting cavity 1713 therebetween. The insulating housing 10 further defines two rectangular locating fillisters 18 spaced from each other and each passing through the top surface 11 and the rear surface 13, and two buckling grooves 19 spaced from each other and each passing through the bottom surface 14 and the front surface 12.

Referring to FIG. 2, each of the terminals 20 has a board-shaped base portion 21. Two opposite side edges of a rear of the base portion 21 extend upward to form a pair of propping portions 22 perpendicular to the base portion 21. Two front edges of the two propping portions 22 extend forward to form two elastic portions 23 which are further inclined towards each other to have a narrower interval between two free ends thereof than an interval between the two propping portions 22. The two free ends of the two elastic portions 23 are punched to form two face-to-face semi-spheroidal contacting portions 24. A top edge of each propping portion 22 protrudes forward to form a fastening portion 25 slightly inclined upward. A middle of a rear edge of one of the propping portions 22 extends rearward and then is bent downward to form a soldering portion 26. Two opposite side edges of a front of the base portion 21 oppositely protrude to form two fastening hooks 27.

Referring to FIG. 2 again, each of the holding elements 30 has a strip-shaped base plate 31 with two locking protrusions 311 being oppositely protruded at two opposite end edges thereof. Two opposite ends of a bottom edge of the base plate 31 extend downward to form a pair of fixing strips 32. A middle of the bottom edge of the base plate 31 extends perpendicularly to the base plate 31 and then is bent downward to form a holding piece 33.

Figure 4:
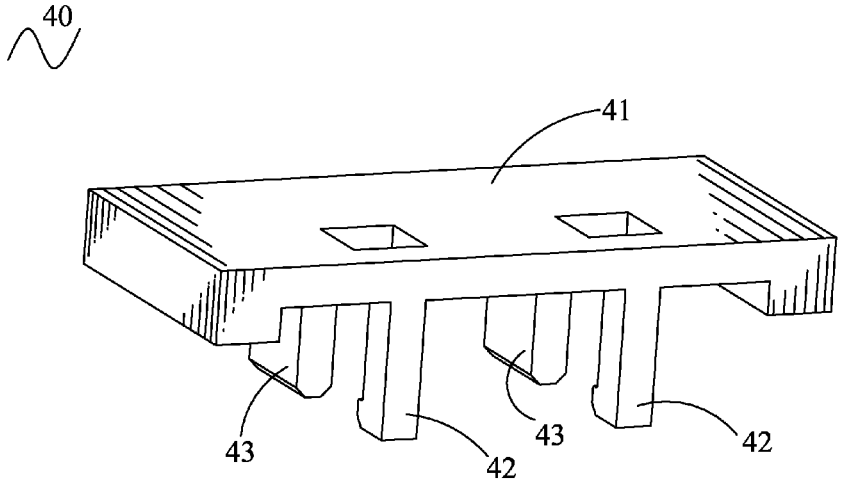
FIG. 4 is a perspective view of a cover of the battery connector of FIG. 1.

Referring to FIG. 2 and FIG. 4, the cover 40 has a rectangular base board 41. A front of a bottom surface of the base board 41 extends downward to form two buckling pillars 42 spaced from and aligned with each other along the transverse direction thereof, and a rear of the bottom surface of the base board 41 extends downward to form two locating pillars 43 spaced from and aligned with each other along the transverse direction thereof.

Referring to FIGS. 1-4 again, when the battery connector 1 is assembled, the terminal 20 is inserted forward into the corresponding terminal cavity 171 of the insulating housing 10 until the propping portions 22 are against the protrusion 1711. The front of the base portion 21 is inserted into the inserting cavity 1713 with the fastening hooks 27 abutting against two opposite insides of the inserting cavity 1713. The elastic portions 23 and the contacting portions 24 are received in the terminal cavity 171. Rear portions of the elastic portions 23 are located above the protrusion 1711. An interstice between the contacting portions 24 faces the receiving groove 172 so that a mating contact can pass through the receiving groove 172 to be electrically clipped between the contacting portions 24. The fastening portions 25 are respectively fastened in the fastening fillisters 1712 for preventing the propping portions 22 swaying and further firmly restraining the terminal 20 in the insulating housing 10. The soldering portion 26 projects out of the terminal cavity 171 for being electrically inserted in a printed circuit board 50 shown in FIG. 6 so as to form an electrical connection between the terminals 20 and the printed circuit board 50. The two holding elements 30 are respectively received in the corresponding holding grooves 151. The base plate 31 of the holding element 30 is received in the fixing slot 1512 with the locking protrusions 311 abutting against two opposite end insides of the fixing slot 1512. The fixing strips 32 are inserted in the inserting slots 1513 respectively. The holding pieces 33 pass through the receiving channels 1511 to project beyond the insulating housing 10 for being inserted in the printed circuit board 50 when the locating pieces 16 press against the printed circuit board 50 shown in FIG. 6 so as to firmly mount the battery connector 1 to the printed circuit board 50. The base board 41 of the cover 40 is mounted on the top surface 11 of the insulating housing 10. Free ends of the buckling pillars 42 are hooked in the corresponding buckling grooves 19 and the locating pillars 43 are respectively inserted in the locating fillisters 18.

Figure 5:
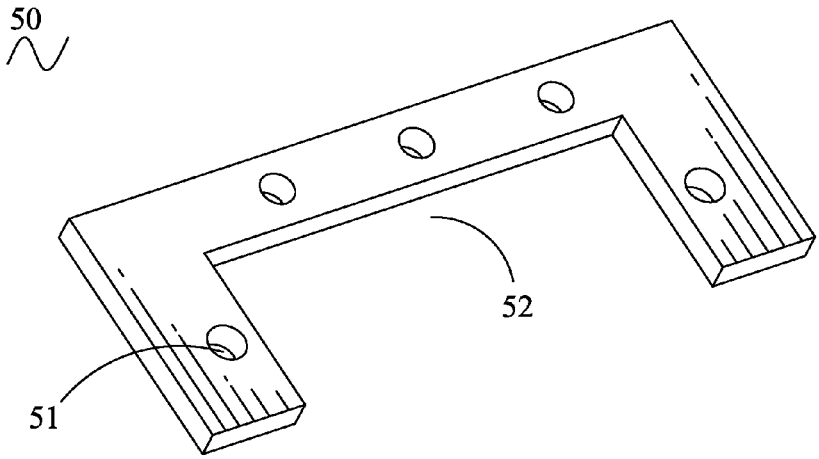
FIG. 5 is a perspective view of a printed circuit board.
Figure 6:
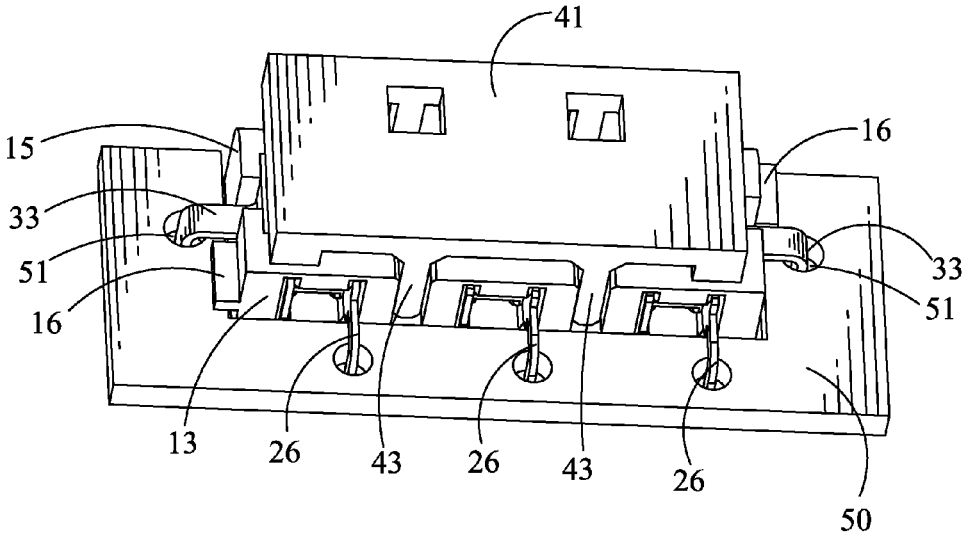
FIG. 6 is a perspective view showing that the battery connector of FIG. 1 is assembled to the printed circuit board of FIG. 5.

Referring to FIG. 1, FIG. 5 and FIG. 6, the battery connector 1 is adapted to be assembled to the printed circuit board 50 with a containing mouth 52 being opened one side thereof. The printed circuit board 50 defines a plurality of inserting holes 51 arranged around the containing mouth 52. When mount the battery connector 1 to the printed circuit board 50, the insulating housing 10 is received in the containing mouth 52 with the locating pieces 16 pressing against the printed circuit board 50. The soldering portions 26 of the terminals 20 and the holding pieces 33 of the holding elements 30 are inserted into the corresponding inserting holes 51.

As described above, when the battery connector 1 is assembled to the printed circuit board 50, the locating pieces 16 of the insulating housing 10 press against the printed circuit board 50 to increase a supporting area of the insulating housing 10 on the printed circuit board 50 so as to make the battery connector 1 located on the printed circuit board 50 firmly, and the holding pieces 33 of the holding elements 30 are inserted into the inserting holes 51 to fasten the insulating housing 10 on the printed circuit board 50 accurately. So that the soldering portions 26 of the terminals 20 can be conveniently soldered to the printed circuit board 50.

What is claimed is:

1. A battery connector adapted for being assembled to a printed circuit board, comprising:

an insulating housing having a top surface, a front surface, a rear surface opposite to the front surface, and two opposite side surfaces, the insulating housing defining a plurality of terminal cavities penetrating through the rear surface and receiving grooves passing through the top surface and the front surface and being connected with the corresponding terminal cavities, two holding grooves being opened in two opposite ends of the insulating housing, a portion of each of the side surfaces of the insulating housing protruding outward to form a locating piece for pressing against the printed circuit board;

two holding elements each having a base plate mounted to the holding groove and a holding piece which extends outward and then is bent downward from a middle of a bottom edge of the base plate, the holding piece projecting out of the holding groove to be inserted into the printed circuit board when the locating piece presses against the printed circuit board; and a plurality of terminals respectively received in the terminal cavities, each of the terminals having a base portion of which two opposite side edges extend upward to form a pair of propping portions, two front edges of the two propping portions extending forward to form two elastic portions, and two contacting portions being protruded from two free ends of the elastic portions to form an interstice therebetween and facing towards the receiving groove, a portion of a rear edge of one of the propping portions extending rearward and then being bent downward to form a soldering portion projecting out of the terminal cavity to be electrically inserted in the printed circuit board.

2. The battery connector as claimed in claim 1, wherein the holding groove includes a fixing slot extending longitudinally and penetrating through the top surface, and a receiving channel connected with a middle of the fixing slot and passing through the corresponding side surface, the base plate is mounted in the fixing slot and the holding piece passes through the receiving channel to project beyond the insulating housing.

3. The battery connector as claimed in claim 2, wherein two outmost ends of the fixing slot extend downward to form a pair of inserting slots, two ends of the bottom edge of the base plate extend downward to form a pair of fixing strips inserted in the corresponding inserting slots.

4. The battery connector as claimed in claim 1, wherein a protrusion protrudes upward from a front of a bottom face of the fastening cavity and has a middle spaced from the bottom face of the fastening cavity to define an inserting cavity therebetween, a front end of the base portion of the terminal is inserted in the inserting cavity.

5. The battery connector as claimed in claim 4, wherein a top edge of each propping portion protrudes forward to form a fastening portion slightly inclined upward, a pair of fastening fillisters are opened in a top inside of the fastening cavity and each extending longitudinally to penetrate through the rear surface, the fastening portions are respectively fastened in the fastening fillisters.

6. The battery connector as claimed in claim 1, further comprising a cover which has a base board, a front of a bottom surface of the base board extending downward to form two buckling pillars spaced from and aligned with each other along a transverse direction thereof, a rear of the bottom surface of the base board extending downward to form two locating pillars spaced from and aligned with each other along the transverse direction thereof, the insulating housing defining two locating fillisters spaced from each other and each passing through the top surface and the rear surface for receiving the corresponding locating pillars therein, and two buckling grooves spaced from each other and each passing through a bottom surface and the front surface for hooking a free end of the corresponding buckling pillars therein.

7. The battery connector as claimed in claim 1, wherein the top surface and the front surface of the insulating housing are connected with each other by an arc face.

* * * * *